US008770586B2

(12) United States Patent
Kody et al.

(10) Patent No.: US 8,770,586 B2
(45) Date of Patent: Jul. 8, 2014

(54) DOUSING GAME

(75) Inventors: Mark William Kody, Berkeley, IL (US); Brent William Kody, Berkeley, IL (US); Polly Fay Kody, Berkeley, IL (US)

(73) Assignee: KO Watergames LLC, Springfield, IL (US)

( * ) Notice: Subject to any disclaimer, the term of this patent is extended or adjusted under 35 U.S.C. 154(b) by 414 days.

(21) Appl. No.: 13/173,666

(22) Filed: Jun. 30, 2011

(65) Prior Publication Data

US 2013/0001878 A1 Jan. 3, 2013

(51) Int. Cl.
*A63B 67/00* (2006.01)

(52) U.S. Cl.
USPC ..... 273/348

(58) Field of Classification Search
USPC ..... 273/348, 378, 390, 391
See application file for complete search history.

(56) References Cited

U.S. PATENT DOCUMENTS 4,093,228 A 6/1978 Pierce
4,534,914 A * 8/1985 Takahashi et al. ..... 261/64.3
4,702,480 A 10/1987 Popeski
5,482,292 A 1/1996 Stone
5,634,642 A 6/1997 Gradolfo
5,839,981 A 11/1998 Rudell
5,947,476 A 9/1999 Rousay
5,947,784 A * 9/1999 Cullen ..... 446/15
6,102,404 A 8/2000 Barker
6,264,201 B1 7/2001 Holsten
6,296,252 B1 10/2001 Hubka
7,185,788 B2 3/2007 Morris
7,784,361 B2 8/2010 Wiedmann

OTHER PUBLICATIONS

U.S. Appl. No. 12/992,881, filed Mar. 17, 2011, Springer, Joshua.

* cited by examiner

*Primary Examiner* — Gene Kim
*Assistant Examiner* — Amir Klayman
(74) *Attorney, Agent, or Firm* — Schafer Smith LLC

(57) ABSTRACT

We disclose a fluid dousing game. The game includes a frame from which a container of fluid is suspended. The release of the fluid is controlled by a valve in the bottom of the container which is created by an opening in the bottom of the container combined with a valve. When a player throws a projectile and strikes a target, a spring loaded mechanism triggers release of the fluid from the container by opening the valve.

7 Claims, 7 Drawing Sheets

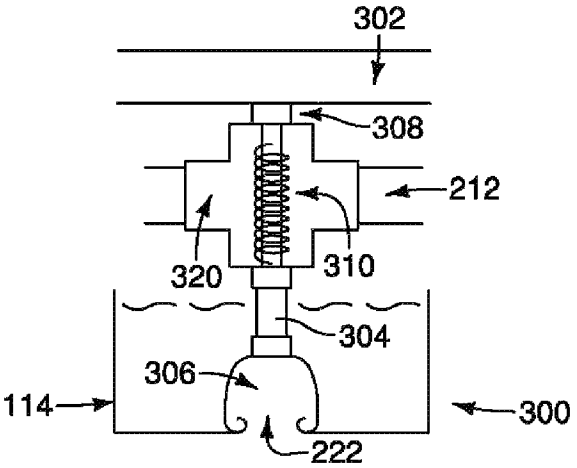
FIG. 4a2
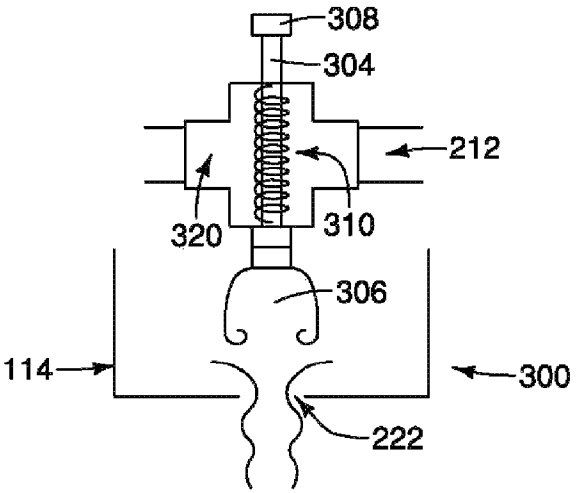
FIG. 4b2
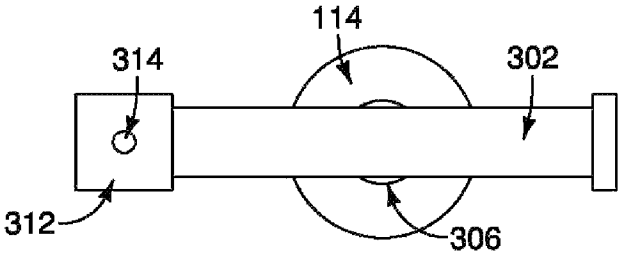
FIG. 4a1
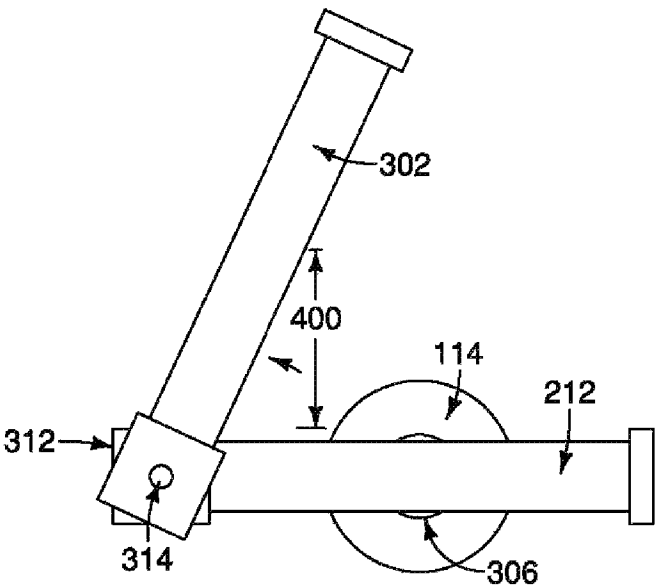
FIG. 4b1

DOUSING GAME

BACKGROUND

Water toys and games are popular among children and adults alike. During hot weather, water games allow players to enjoy the outdoors and also provide cooling relief from the hot sun. For example, during hot weather—such as during the spring and summer months in the American Midwest, families and communities gather for recreation at street fairs, carnivals, fund-raisers, parks, in back yards, at community centers, and at local restaurants and bars.

Toys and games involving using projectiles to strike a target are popular recreational items. In general, players enjoy the skill involved in projecting balls, bean bags, darts, and other items toward a target. Toys and games of this nature provide enjoyment and camaraderie.

BRIEF SUMMARY

A water dousing game provides a container suspended above a player, or alternatively, above a beverage glass. The container holds a fluid which may be, for example, water or a beverage. The container includes a valve that controls the release of the fluid. The valve is connected to an actuating arm. The actuating arm has an attached target. The valve is actuated to release the fluid from the container and onto a player or into a beverage glass when a projectile thrown by a second player strikes the target.

Other systems, methods, features, and advantages of the disclosure will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

FIG. 4*a*1 illustrates a top view of a swing arm of the game;

FIG. 4*a*2 illustrates a side cut-out view of a "play mode";

FIG. 4*b*1 illustrates a top view of a swing arm of the game in "release mode";

FIG. 4*b*2 illustrates a side cut-out view of a "release mode";

DETAILED DESCRIPTION

We disclose a toy and game that releases fluid onto a player when another player successfully projects a projectile onto a target. The toy and game may also be used to release fluid, such as a beverage, into a beverage glass when a player successfully projects a projectile onto a target. The toy may include a fluid container, a valve, and an actuating arm. The fluid container may remain substantially stationary and upright throughout game play and may have a fluid escape opening. A valve may regulate fluid escape from the container. An actuating arm may regulate the actuation state of the valve. For example, the actuating arm may include a target for a projectile. When a player throws a projective and successfully strikes the target, the actuating arm may actuate the valve to release fluid from the container.

The dousing game may be made of light materials which are easy to assemble, disassemble, store, and carry. The dousing game may be scaled to various sizes. For example, the dousing game may be scaled to permit the placement of an adult chair beneath the container. Alternatively or additionally, the dousing game may be scaled to accommodate a child's chair. Alternatively or additionally, the dousing game may be scaled to accommodate a beverage glass.

Figure 1:
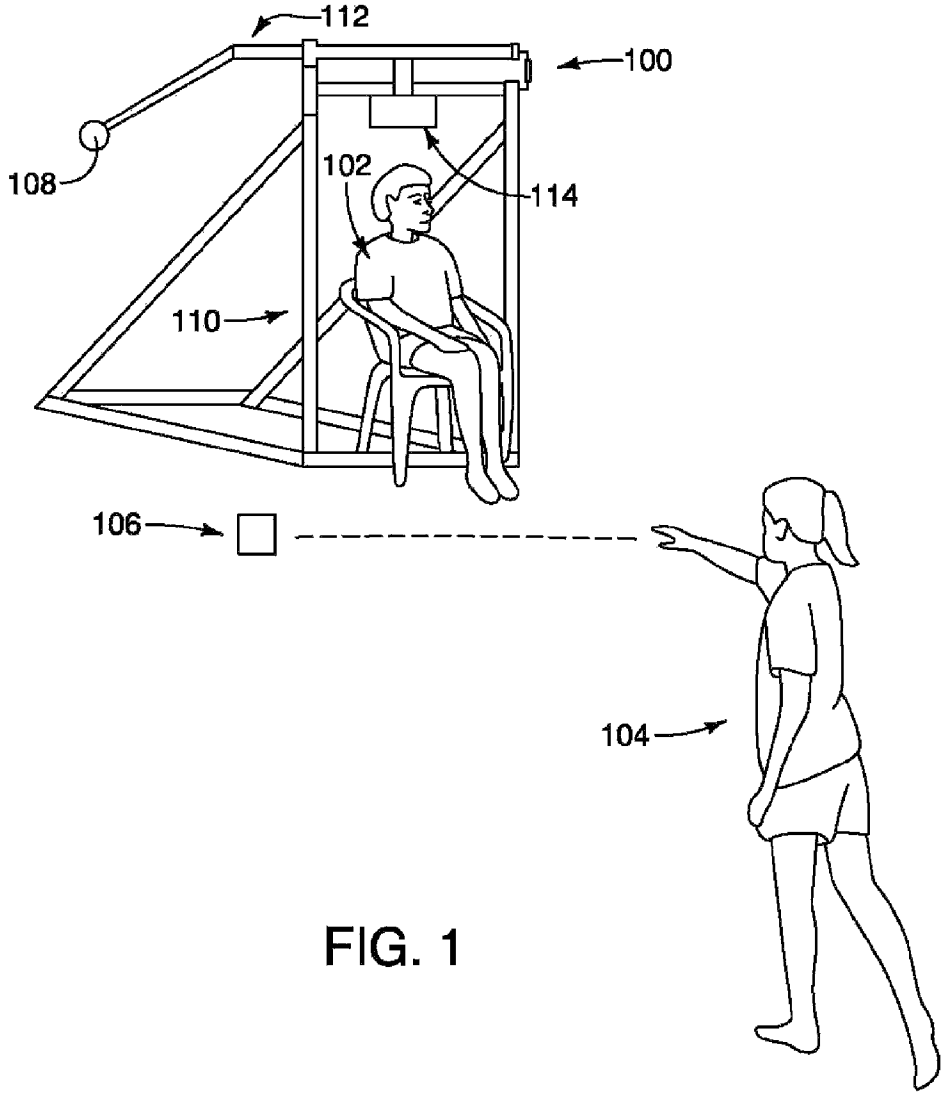
FIG. 1 illustrates a variation of the dousing game in use.

FIG. 1 illustrates one variation of a dousing game. In this variation, the dousing game includes a dousing game assembly 100, a player 102 and a thrower 104. In this illustration, the player 102 is seated; however, the player 102 may also be standing. A thrower 104 may throw a projectile 106 at a target 108. When the projectile 106 strikes the target 108, fluid may be released onto the player 102. The projectile 106 may be a bean bag, a ball, a FRISBEE, a dart, a paint gun, a laser gun, a water balloon, or any other item. The target 108 may have any shape; it may be, for example but not limited to, a circle, square, star, box. The target may be triggered by the force of the projectile, or alternatively or additionally, by a laser target and laser receiver. The target may also include a net for retaining the target or alternatively or additionally, a back board or other device for halting the trajectory of the target.

The dousing game assembly 100 may include a support assembly 110, an actuator assembly 112, and a container 114. The support assembly 110 supports the container 114 above the player 102. The actuator assembly 112 actuates the release of fluid from the container 114 on to the player 102 such that the player 102 is doused.

Figure 2:
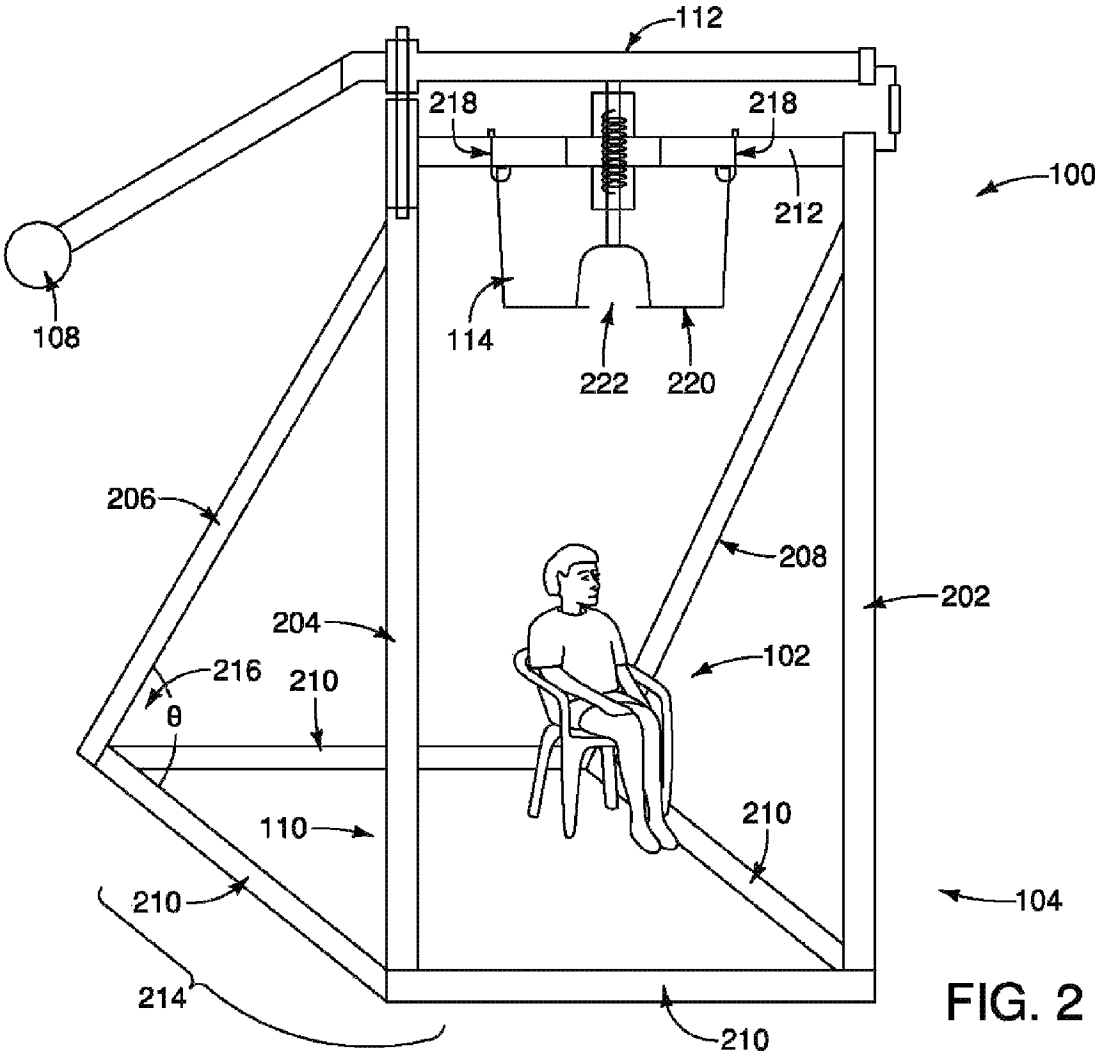
FIG. 2 illustrates a variation of the dousing game.

As shown in FIG. 2, the support assembly 110 may comprise one or more vertical posts, e.g., a first vertical post 202 and a second vertical post 204; one or more diagonal posts, e.g., a first diagonal post 206 and a second diagonal post 208; and one or more horizontal posts 210. The support assembly 110 may further include a horizontal support bar 212. The horizontal posts 210 may engage the diagonal posts 206, 208, and the vertical posts 202, 204, to create the frame of the support assembly 110. The support assembly 110 may engage the ground such that the support assembly 110 is held upright during normal use.

For example, in one variation, four horizontal posts 210 may form a four-cornered base 214. The vertical posts 202, 204 may engage, for example at a 90° angle, two adjacent corners of the four-cornered base 214. The diagonal posts 206, 208 may engage the two remaining corners of the four-cornered base 214. The diagonal posts 206, 208 may engage the two remaining corners of the four-cornered base 214 at an angle 216. The angle 216, may be for example but not limited to, about 5° to about 90°; about 20° to about 70°; about 40° to about 60°; or otherwise. If the angle 216 is less than 90°, then the diagonal posts 206, 208, may also engage the vertical posts 202, 204, at some location along the length of the vertical posts 202, 204. In any variation of the dousing game, the support posts, frame, legs, or otherwise, may be adjustable. For example, the support posts, frame, legs, or otherwise may adjust to smaller or larger dimensions. The support posts, frame, legs, or otherwise may additionally or alternatively adjust and fold for, among other things, storage and/or carrying.

In this example, the horizontal support bar 212 engages the vertical bars 202, 204 at a location distal from the ground and above the player 102. The horizontal support bar 212 supports the container 114 and also supports a portion of the actuator assembly 112. The container 114 may be attached to the horizontal support bar 212 by an attachment means 218. The container 114 may be attached such that it is maintained in a substantially upright and stationary position during play. The attachment means 218 may be, for example but not limited to, a screw, bolt (e.g., a J-Bolt or otherwise), pin, bar, zip tie, wire, chain and etc. The container 114 may be, for example but not limited to, a bucket, funnel, box, jar, or otherwise. For simplification, in this example, the container 114, may be a bucket. The bucket may have a top opening and a bottom 220. The bottom 220 may include a fluid escape opening 222. The fluid escape opening 222 may be a single opening or may be an arrangement of multiple openings.

Figure 3:
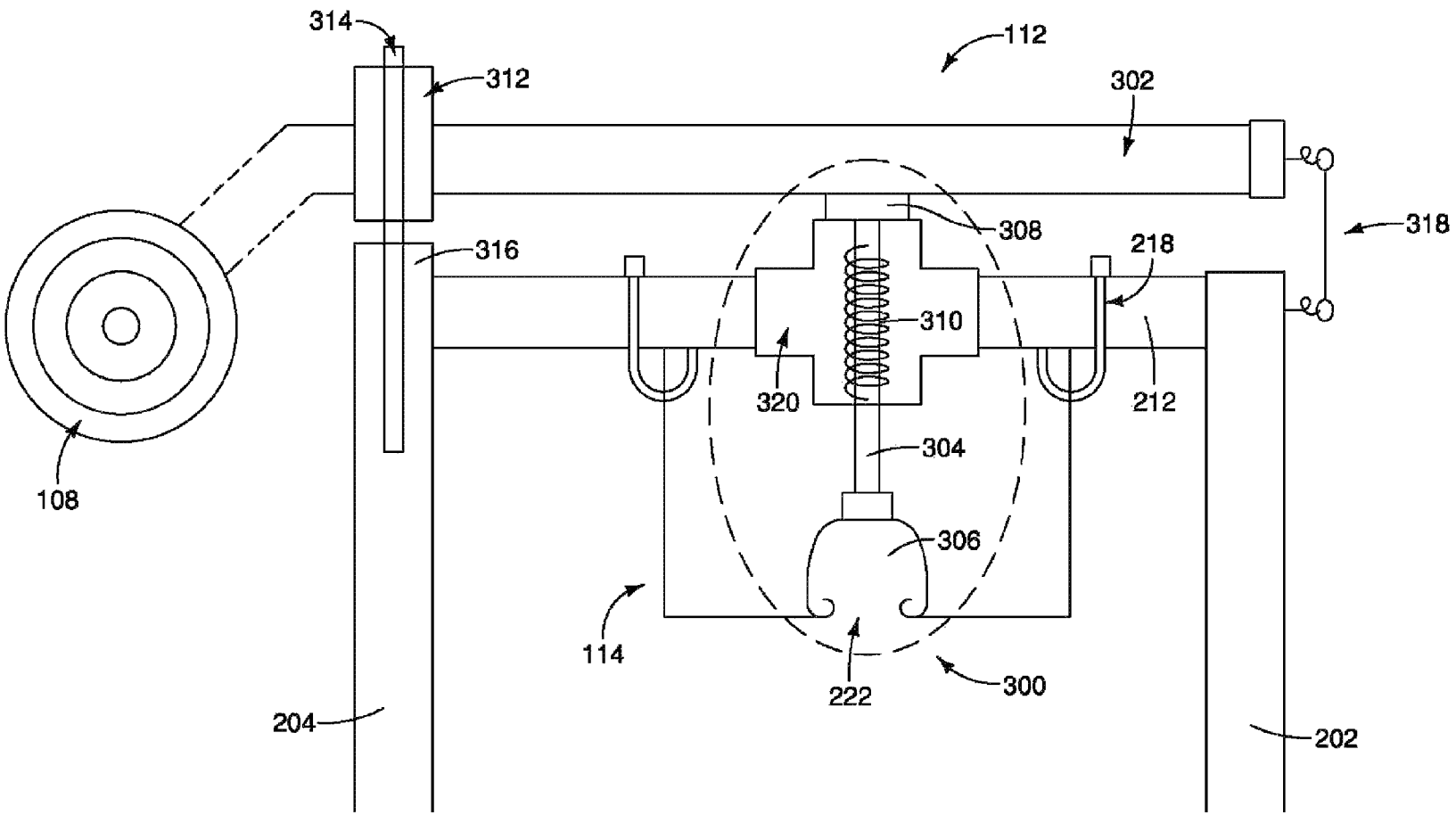
FIG. 3 illustrates an exploded view of the actuation assembly.

FIG. 3 shows a blow up of the actuator assembly 212 of this variation. The actuator assembly may include a swivel arm 302, which may be a horizontal bar that is suspended parallel to the horizontal support arm 212 when the game is in "play mode." For example, the game may be in "play mode" when the container 114 contains a fluid, for example, when the fluid is maintained within the container 114 and is not leaking or flowing out of the container 114. Then the game is in "release mode," the fluid escape opening 222 of container 114 may be exposed and fluid may be leaking or flowing out, for example, onto a player FIG. 1, 102. When the game is in "release mode" the swivel arm 302 may be still horizontal and above the horizontal support bar 212, but may be off-set from it's parallel position. (This is further demonstrated in FIG. 4). The container 114 may remain substantially upright and stationary during "release mode."

The actuator assembly 112 may include a valve assembly 300. The valve assembly may comprise an actuation housing 320, an actuation rod 304 and a valve 306. The horizontal support bar 212 may pass horizontally through the actuation housing 320. The actuation rod 304 may have a cap 308 on one end and may be connected to the valve 306 at the other end. The actuation rod 304 may pass vertically through the actuation housing 320, and suspend the valve 306 from the horizontal support bar 212 such that the valve 306 is supported inside the container 114. The cap 308 may have a larger diameter than the actuation rod 304 and may therefore maintain the actuation rod 304 in assembly with the actuation housing 320 by proving an obstruction that is unable to pass through the hole through which the actuation rod passes.

The actuation rod 304 may be assembled with a spring 310. For example, a spring 310, for example but not limited to a tension spring may be a coil of material (e.g., stainless steel, plastic, resin, or otherwise). The coil may have through its middle a hole. The actuation rod 304 may be assembled with the spring 310 by passing the actuation rod 304 through the hole in the spring 310. The actuation rod 304 and spring 310 may be assembled inside of the actuation housing 320. Further figures illustrate other methods of assembling the actuation rod 304 with the spring 310. However, for this example, we show the actuation rod 304 assembled with the spring 310 by passing through a hole in the spring 310, the actuation rod 304 and the spring 310 assembled inside an actuation housing 320.

The valve 306 may be assembled over the fluid escape opening 222. When the game is in "play mode" the valve 306 may seal the fluid escape opening 222 such that fluid is maintained inside the container 114. When the game is in "release mode," the valve 306 may move away from and reveal the fluid escape opening 222 such that fluid is released from the container 114.

The valve 306 may be, for example but not limited to, a rubber valve, a plunger, or any other device. The valve may operate by simply obstructing the fluid escape opening 222. Alternatively or additionally, the valve 306 may be a plunger—or like object—which may create a suction seal against the fluid escape opening 222. For example, the pressure of the swing arm 302 against the cap 308, the cap 308 against the actuation rod 304, and the actuation rod 304 against the valve 306 may create increased suction, pressure, or otherwise, and seal the valve 306 against the fluid escape opening 222.

The swivel arm 302 may have two ends. For example, the swivel arm 302 may have a first end that lines up with a second vertical post 204 and an end that lines up with a first vertical post 202. The swing arm 302 may be attached to a target 108 at one end. The swivel arm 302 may rotate around a swivel arm rod 314. The swivel arm rod 314 may pass vertically through, for example, the junction 316 of the second vertical post 204 and the horizontal support bar 212.

When the game is in "play mode," the swivel arm 302 may, by exerting force upon the cap 308 push the actuation rod 304 deep into the actuation housing 320 which may push the valve 306 against the bottom 220 of the container 114 such that the valve 306 tightly covers and prevents fluid escape from the fluid escape opening 222 in the container 114. The swivel arm 302 may be connected at one end to a target 108. When a projectile FIG. 1, 106 strikes the target 108, it may cause the swivel arm 302 to swivel on the swivel arm rod 314 and to dislodge from its parallel position. When the swivel arm 302 dislodges from its position parallel to the horizontal support bar 212, it no longer exerts force upon the cap 308. When the force of the swivel arm 302 pushing down on the cap 308 is released, the force of the spring 310 inside the actuation housing 320 may push the cap 308 upwards and away from the actuation housing 320. As the cap moves upwards the connected actuation rod 304 may also travel vertically upward through the actuation housing 320 such that the valve 306 moves closer to the actuation housing 320. As the valve 306 moves closer to the actuation housing 320, the valve 306 may disengage from the fluid escape opening 222. Disengagement of the valve 306 from the fluid escape opening 222 may allow fluid release from the container through the fluid escape opening 222.

A retaining device 318 may restrict the movement of the swing arm 302 relative to the horizontal support bar 212. In one variation, the retaining device 318 may be a device similar to an eye and eye turn buckle. For example, the retaining device 318 may be a bar with a length and two ends. One end may attach to the swing arm 302 and the other end may attach to the horizontal support bar 212. If the retaining device 318 is an eye and eye turn buckle, one eye may attach to the to the swing arm 302 and the other eye may attach to the horizontal support bar 212. The length of the retaining device 318 may be adjusted so that, when the swing arm is in "play mode," the swing arm is pressed tightly against the cap 308 of the actuation rod 304 providing the force necessary to keep the valve 306 over and sealing the fluid escape opening 222. When the swing arm 302 is activated to swing away from its horizontal parallel position, the retaining device 318 may restrict the distance (e.g., FIG. 4, 400) that the swing arm 302 may move. This may, for example but not limited to, prevent the swing arm 302 from moving too far and wounding a bystander, and may make it easier to reassemble the swing arm 302 into "play mode."

Other restraining devices 318 have been contemplated, for example but not limited to, rubber bands, restraining frames, and other methods of restraining the movement of the swing arm 302 and, perhaps, providing additional force to push the swing arm 302 against the cap 308. Alternatively or additionally, the swing arm 302 may be weighted, for example with sand, cement, metal, or etc.

FIG. 4 illustrates the working of one variation of a dousing game. FIG. 4*a*1 illustrates the swing arm 302 in "play mode" from above. FIG. 4*b*1 illustrates the swing arm 302 relative to the horizontal support bar 212 from above in "release mode." FIG. 4*a*2 illustrates the orientation of the valve 306 over the fluid escape opening 222 as well as the orientation of the swing arm 302 relative to the cap 308 and the cap 308 relative to the actuation housing 320 when the game is in "play mode." FIG. 4*b*2 illustrates the orientation of the valve 306 over the fluid escape opening 222 as well as the orientation of the cap 308 relative to the actuation housing 320 when the game is in "play mode." For convenience, the swing arm 302 is not shown in this FIG. 4*b*2.

As shown in FIG. 4*a*1, the swivel arm 302 may rotate around a swivel arm rod 314. The swivel arm rod 314 may pass vertically through, for example, the junction 316 of the second vertical post 204 and the horizontal support bar 212 (not shown).

When the game is in "play mode," the swivel arm 302 may, by exerting force upon the cap FIG. 4*b*2, 308 push the actuation rod 304 deep into the actuation housing 320 which may push the valve 306 against the bottom 220 of the container 114 such that the valve 306 tightly covers and prevents fluid escape from the fluid escape opening 222 in the container 114.

As discussed and illustrated before, the swivel arm 302 may be connected at one end to a target 108. When a projectile FIG. 1, 106 strikes the target 108, it may cause the swivel arm 302 to swivel on the swivel arm rod 314 and to dislodge from its parallel position (see FIG. 4*b*1). FIG. 4*b*1 illustrates an example that when the swivel arm 302 dislodges from its position parallel to the horizontal support bar 212 by a distance 400, it no longer exerts force upon the cap 308 (See FIG. 4*b*2). When the force of the swivel arm 302 pushing down on the cap 308 is released, as in FIG. 4*b*2, the force of the spring 310 inside the actuation housing 320 may push the cap 308 upwards and away from the actuation housing 320. As the cap moves upwards the connected actuation rod 304 may also travel vertically upward through the actuation housing 320 such that the valve 306 moves closer to the actuation housing 320. As the valve 306 moves closer to the actuation housing 320, the valve 306 may disengage from the fluid escape opening 222. Disengagement of the valve 306 from the fluid escape opening 222 may allow fluid release from the container through the fluid escape opening 222.

Figure 5:
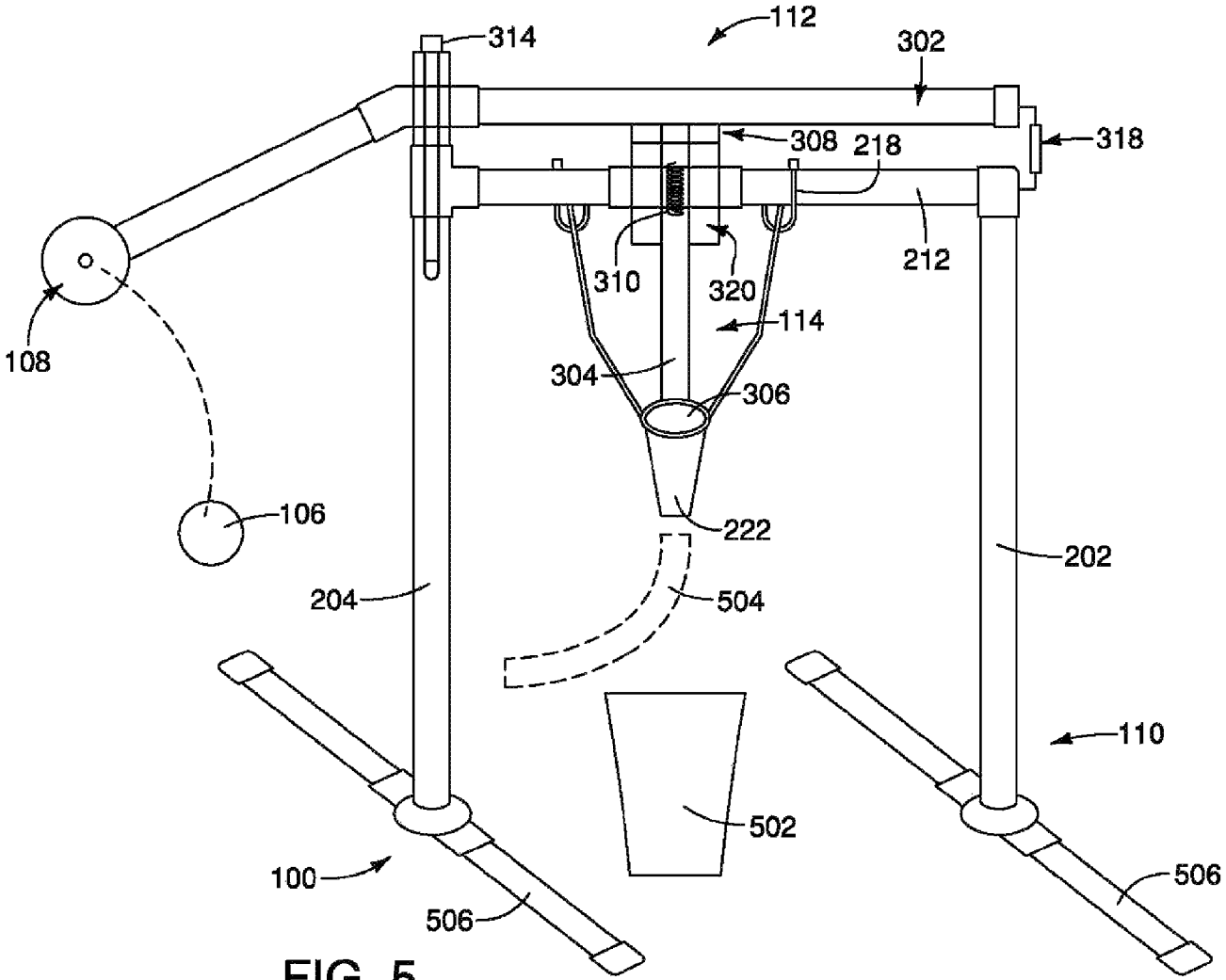
FIG. 5 illustrates a variation of a dousing game.

FIG. 5 illustrates a second variation of a dousing game. In this variation, the game includes a dousing game assembly 100, a drinking container 502 and a thrower 104 (not shown). In this illustration, the drinking container 502 placed beneath the container 114. A thrower 104 may throw a projectile 106 at a target 108. When the projectile 106 strikes the target 108, fluid may be released into the drinking container 502. The projectile 106 may be a bean bag, a ball, a FRISBEE, a dart, paint from a paint gun, or any other item. In this or any other variation, a tube 504 may be included with the game assembly 100. The tube 504 may direct the fluid, which may be a beverage, from the container into the drinking container 502. The tube 504 may therefore prevent spilling.

The dousing game assembly 100 may include a support assembly 110, an actuator assembly 112, and a container 114. The support assembly 110 supports the container 114 above the drinking container 502. The actuator assembly 112 actuates the release of fluid from the container 114 into the drinking container 502 (in one variation, through an attached tube 504) such that the fluid enters the drinking container 502 for consumption by a player. The fluid could be a fluid that the thrower 104 may enjoy, such as cola, beer, hot chocolate. Alternatively or additionally, the fluid may be monetary coins, confetti, or any other demonstrative item.

As shown in FIG. 5, the support assembly 110 may comprise one or more vertical posts, e.g., a first vertical post 202 and a second vertical post 204; and one or more horizontal posts 506. The support assembly 110 may further include a horizontal support bar 212. The horizontal posts 210 may engage the vertical posts 202, 204, to create the frame of the support assembly 110. The support assembly 110 may engage the ground such that the support assembly 110 is held upright during normal use.

For example, in one variation, the vertical posts 202, 204 may engage, for example at a 90° angle, two a central region of the horizontal posts 506.

In this example, the horizontal support bar 212 engages the vertical bars 202, 204 at a location distal from the ground and above the drinking container 502. The horizontal support bar 212 supports the container 114 and also supports a portion of the actuator assembly 112. The container 114 may be attached to the horizontal support bar 212 by an attachment means 218. The attachment means 218 may be, for example but not limited to, a screw, bolt (e.g., a J-Bolt or otherwise), pin, bar, and etc. The container 114 may be, for example but not limited to, a bucket, funnel, box, jar, or otherwise. For simplification, in this example, the container 114, may be a funnel. The funnel may have a top opening and a bottom 220. The bottom 220 may include a fluid escape opening 222, which may be the tapered opening of the funnel. The tapering of the funnel may provide a male end for attaching the alternative hose 504.

The actuator assembly may include a swivel arm 302, which may be a horizontal bar that is suspended parallel to the horizontal support arm 212 when the game is in "play mode." For example, the game may be in "play mode" when the container 114 contains a fluid, for example, when the fluid is maintained within the container 114 and is not leaking or flowing out of the container 114. Then the game is in "release mode," the fluid escape opening 222 of container 114 may be exposed and fluid may be leaking or flowing out, for example, into a drinking container 502, or alternatively, through a tube 504 into a drinking container. When the game is in "release mode" the swivel arm 302 may be still horizontal and above the horizontal support bar 212, but may be off-set from it's parallel position. (This is further demonstrated in FIG. 4).

The actuator assembly 112 may include a valve assembly FIG. 3, 300. The valve assembly may comprise an actuation housing 320, an actuation rod 304 and a valve 306. The horizontal support bar 212 may pass horizontally through the actuation housing 320. The actuation rod 304 may have a cap 308 on one end and may be connected to the valve 306 at the other end. The actuation rod 304 may pass vertically through the actuation housing 320, and suspend the valve 306 from the horizontal support bar 212 such that the valve 306 is supported inside the container 114. The cap 308 may have a larger diameter than the actuation rod 304 and may therefore maintain the actuation rod 304 in assembly with the actuation housing 320 by proving an obstruction that is unable to pass through the hole through which the actuation rod passes.

The actuation rod 304 may be assembled with a spring 310. For example, a spring 310, for example but not limited to a tension spring may be a coil of material (e.g., stainless steel, plastic, resin, or otherwise). The coil may have through its middle a hole. The actuation rod 304 may be assembled with the spring 310 by passing the actuation rod 304 through the hole in the spring 310. The actuation rod 304 and spring 310 may be assembled inside of the actuation housing 320. Further figures illustrate other methods of assembling the actuation rod 304 with the spring 310. However, for this example, we show the actuation rod 304 assembled with the spring 310 by passing through a hole in the spring 310, the actuation rod 304 and the spring 310 assembled inside an actuation housing 320.

The valve 306 may be assembled over the fluid escape opening 222. When the game is in "play mode" the valve 306 may seal the fluid escape opening 222 such that fluid is maintained inside the container 114. When the game is in "release mode," the valve 306 may move away from and reveal the fluid escape opening 222 such that fluid is released from the container 114.

The valve 306 may be, for example but not limited to, a rubber valve, a plunger, or any other device. The valve may operate by simply obstructing the fluid escape opening 222. Alternatively or additionally, the valve 306 may be a plunger—or like object—which may create a suction seal against the fluid escape opening 222. For example, the pressure of the swing arm 302 against the cap 308, the cap 308 against the actuation rod 304, and the actuation rod 304 against the valve 306 may create increased suction, pressure, or otherwise, and seal the valve 306 against the fluid escape opening 222.

The swivel arm 302 may have two ends. For example, the swivel arm 302 may have a first end that lines up with a second vertical post 204 and an end that lines up with a first vertical post 202. The swing arm 302 may be attached to a target 108 at one end. The swivel arm 302 may rotate around a swivel arm rod 314. The swivel arm rod 314 may pass vertically through, for example, the junction 316 of the second vertical post 204 and the horizontal support bar 212.

When the game is in "play mode," the swivel arm 302 may, by exerting force upon the cap 308 push the actuation rod 304 deep into the actuation housing 320 which may push the valve 306 against the bottom 220 of the container 114 such that the valve 306 tightly covers and prevents fluid escape from the fluid escape opening 222 in the container 114. The swivel arm 302 may be connected at one end to a target 108. When a projectile 106 strikes the target 108, it may cause the swivel arm 302 to swivel on the swivel arm rod 314 and to dislodge from its parallel position. When the swivel arm 302 dislodges from its position parallel to the horizontal support bar 212, it no longer exerts force upon the cap 308. When the force of the swivel arm 302 pushing down on the cap 308 is released, the force of the spring 310 inside the actuation housing 320 may push the cap 308 upwards and away from the actuation housing 320. As the cap moves upwards the connected actuation rod 304 may also travel vertically upward through the actuation housing 320 such that the valve 306 moves closer to the actuation housing 320. As the valve 306 moves closer to the actuation housing 320, the valve 306 may disengage from the fluid escape opening 222. Disengagement of the valve 306 from the fluid escape opening 222 may allow fluid release from the container through the fluid escape opening 222.

A retaining device 318 may restrict the movement of the swing arm 302 relative to the horizontal support bar 212.

The height of the dousing game may be adjusted so that it rests on the ground, or alternatively, for example if the object is to dispense a beverage into a container 502, the game may rest on a table or counter.

The valve 306 may be, for example but not limited to, a rubber valve, a plunger, or any other device. The valve may operate by simply obstructing the fluid escape opening 222. Alternatively or additionally, the valve 306 may be a plunger—or like object—which may create a suction seal against the fluid escape opening 222. For example, the pressure of the swing arm 302 against the cap 308, the cap 308 against the actuation rod 304, and the actuation rod 304 against the valve 306 may create increased suction, pressure, or otherwise, and seal the valve 306 against the fluid escape opening 222.

Figure 6:
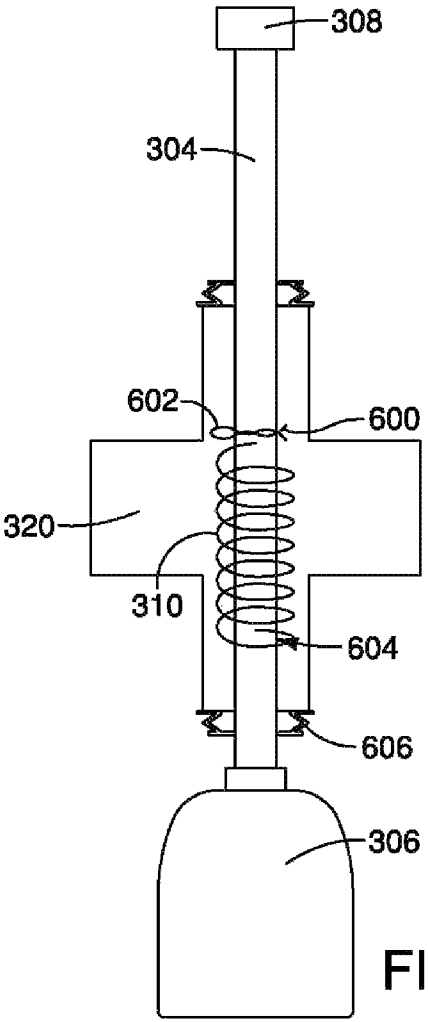
FIG. 6 illustrates a exploded view of a first spring mechanism.

FIG. 6 is a exploded view of one variation of the cap 308, actuation rod 304, valve 306, spring 310, and actuation housing 320. This view illustrates one manner in which the spring 310 may store potential energy such that, when potential energy is released, (e.g. by release of the swing arm 302 from the cap 308) the spring 310 releases potential energy, and in this variation, extends to pull the valve 306 away from the fluid escape opening 222. In this example, the actuation rod 304 is assembled with the spring 310 inside the actuation housing 320. The spring 310 has a first end 602 and a second end 604. The first end 602 of the spring 310 may be immobilized relative to the actuation rod 304. For example, the actuation rod 304 may include a cotter pin hole. An immobilization device 600, which may be a cotter pin (or similar device) fed through the cotter pin hole. The immobilization device 600 may immobilize one end of the spring 310 restricting it from expanding further up on the actuation rod 304 toward the cap 308.

The second end 604 of the spring 310 may not be immobilized relative to the actuation rod 304. Actuation housing 320 may have a floor 606 through which the actuation rod 304 may pass. When the swing arm 302 is in "release mode" the spring 310 may be in a more relaxed state (see FIG. **4*b*2). When the swing arm 302 is in "play mode" it may exert force on the cap 308 of the actuation rod 304. Because the immobilization device 600 is attached to the actuation rod 304, the immobilization device 600 may exert force against the first end of the spring 602. As the actuation rod 304 travels through the actuation housing 320 the distance between the immobilization device 600 and the floor 606 of the actuation housing 320 shortens. The floor 606 of the actuation housing 320 eventually exerts a force up against the second end 604 of the spring 310 causing the spring 310 to become more tightly coiled or compressed; the compression storing elastic potential energy in the spring 310. The movement of the spring arm 302 off of the cap 308 releases the downward pressure (e.g., the pressure that asserts compression on the spring 310) causing release of the potential energy stored in the spring 310**.

Figure 7:
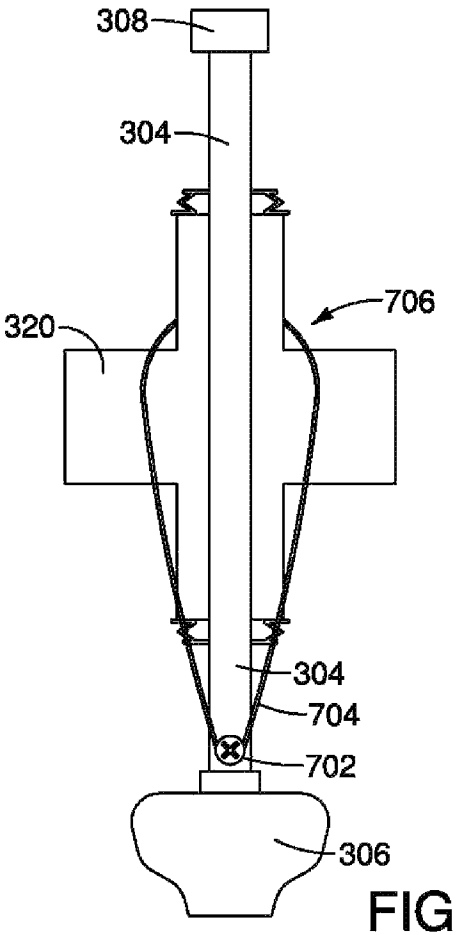
FIG. 7 illustrates a exploded view of a second spring mechanism.

FIG. 7 illustrates a variation of the orientation and operation of the actuation arm 302 relative to the actuation housing 320. FIG. 7 is an exploded view of another variation of the cap 308, actuation rod 304, valve 306, spring 704, and actuation housing 320. This view illustrates one manner in which the spring 704 may store potential energy, when pressure is released from the cap 308 the spring 310 releases potential energy resulting in pulling the valve 306 away from the fluid escape opening 222.

In this example, the actuation rod 304 is assembled inside the actuation housing 320. The spring 704 is a rubber or other elastic material band. The spring 704, which may be a rubber band, is assembled with the actuation housing and the actuation rod 304. In this example, the spring 704, which may be a rubber band, is wrapped around the neck of the actuation housing and also wrapped around a screw 702 driven through the actuation rod 304. (Other orientations are possible, the spring 704 may be also attached to the actuation housing 320 by a screw, may be attached inside or outside of the actuation housing 320, and otherwise.)

When the swing arm 302 is in "release mode" the spring 704 may be in a more relaxed state, e.g., if the spring 704 is a rubber band, it may be in an unstretched state. When the swing arm 302 is in "play mode" it may exert force on the cap 308 of the actuation rod 304. Because the spring 704, which may be a rubber band, is attached to the actuation housing 320 and the actuation rod 304, as the actuation rod 304 travels through the actuation housing 320 the distance between the neck 706 of the actuation housing 320 and the screw 702 on the actuation rod 304 increases. The increased distance between the two attachment points of the spring 704, which may be a rubber band causes stretching of the rubber band, the stretching storing elastic potential energy in the spring 704. The movement of the spring arm 302 off of the cap 308 releases the downward pressure (e.g., the pressure that asserts compression on the spring 310) causing release of the potential energy stored in the spring 704, as the spring 704 returns to a relaxed state.

Figure 8:
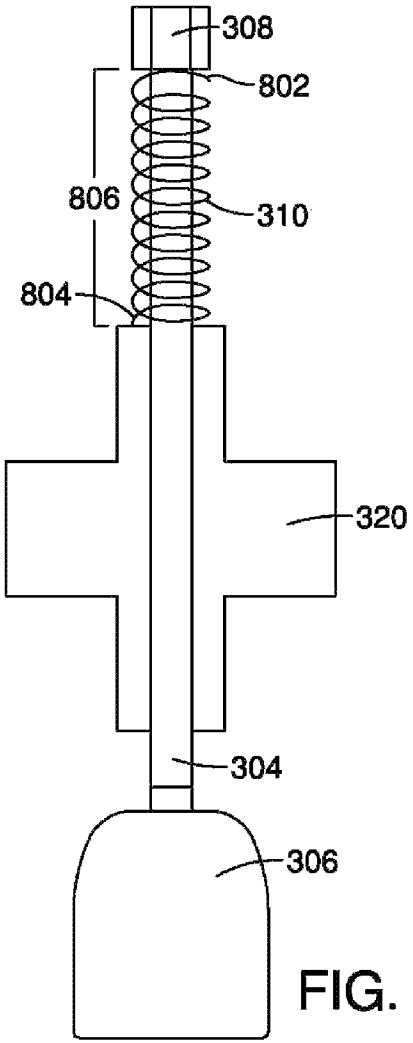
FIG. 8 illustrates a exploded view of a third spring mechanism.

FIG. 8 is an exploded view of another variation of the cap 308, actuation rod 304, valve 306, spring 310, and actuation housing 320. This view illustrates one manner in which the spring 310 may store potential energy such that, when potential energy is released, (e.g. by release of the swing arm 302 from the cap 308) the spring 310 releases potential energy, and in this variation, extends to allow the valve 306 to pull away from the fluid escape opening 222. In this example, the actuation rod 304 is assembled with the spring 310 outside and on top of the actuation housing 320. The spring 310 has a first end 802 and a second end 804. The cap 308 may act as an immobilization device and may immobilize one end of the spring 310 restricting it from expanding further up on the actuation rod 304. The second end 804 of the spring 310 may be immobilized relative to the actuation rod 304 by the top of the actuation housing 320.

In this variation, when the swing arm FIG. 3, 302 is in "release mode" the spring 310 may be in a more relaxed state (e.g., uncompressed). When the swing arm 302 is in "play mode" the swing arm 302 may exert force on the cap 308 of the actuation rod 304. As the actuation rod 304 travels through the actuation housing 320 the distance between the cap 308 and the top of the actuation housing 320 shortens. Because the spring 310 is located between the cap 308 and the top of the actuation housing 320, as the distance 806 shortens, the spring 310 is compressed. The compression stores elastic potential energy in the spring 310. The movement of the spring arm 302 off of the cap 308 releases the downward pressure (e.g., the pressure that asserts compression on the spring 310) causing release of the potential energy stored in the spring 310.

Figure 9:
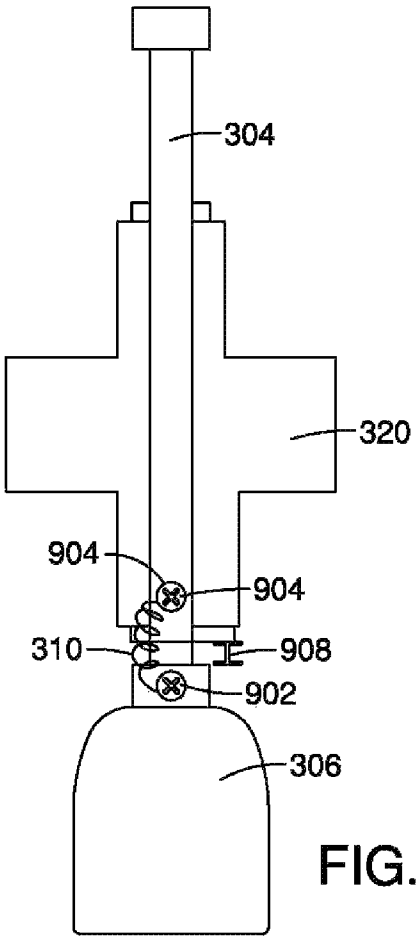
FIG. 9 illustrates a exploded view of a fourth spring mechanism.

FIG. 9 is an exploded view of another variation of the cap 308, actuation rod 304, valve 306, spring 310, and actuation housing 320. This view illustrates one manner in which the spring 310 may store potential energy such that, when potential energy is released, (e.g. by release of the swing arm 302 from the cap 308) the spring 310 releases potential energy, and in this variation, extends to allow the valve 306 to pull away from the fluid escape opening 222. In this example, the actuation rod 304 is assembled with the spring 310 outside and on top of the actuation housing 320. Furthermore, in this example, the actuation rod 304 is not inserted through the spring's 310 coil. The spring 310 has a first end 902 and a second end 904. The first end 902 and second end 904 may be immobilized, for example, the first end 902 may be immobilized by a screw attaching it to a location just above the valve 306, the second end 904 may be immobilized by a screw attaching it to an outer or inner surface of the actuation housing 320.

In this variation, when the swing arm FIG. 3, 302 is in "release mode" the spring 310 may be in a more relaxed state (e.g., uncompressed). When the swing arm 302 is in "play mode" the swing arm 302 may exert force on the cap 308, causing the actuation rod 304 to travel through the actuation housing 320. As the actuation rod 304 travels through the actuation housing 320 a distance 908 between the valve 308 and the actuation housing 320 lengthens. Because the spring 310 is located between the valve 306 and the actuation housing 320, as the distance 908 lengthens, the spring 310 is pull tightly. The stretching stores elastic potential energy in the spring 310. The movement of the spring arm 302 off of the cap 308 releases the downward pressure (e.g., the pressure that asserts compression on the spring 310) causing release of the potential energy stored in the spring 310 as it springs into a relaxed (in this case, coiled) state.

The dousing game may be made of many materials. For a light and sturdy construction, the dousing game may be made out of PVC pipe. However, the dousing game may alternatively or additionally be made out of metal, plastic, rubber, or other composite or similar materials. If made out of PVC pipe, the entire dousing game assembly may weigh under 30 pounds, for example, if the dousing game assembly is made out of PVC with a 6 foot frame, such that an adult may sit comfortably beneath the container 114, the assembly may weigh as little as about 20 pounds. The dousing game may be completely assembled and disassembled simply and quickly, may be stored in a compact box, and may weigh very little, making it simple to store, transport, assemble, and use.

In one variation, the dousing game may be scaled for table-top used, for example, the object of the game may be to strike the target 108 in order to trigger a beverage to pour into a drinking container 502. In this variation, the materials may be PVC pipe, alternatively or additionally, the materials may be metal, plastic, rubber, composite, or otherwise. The weight of the table-top dousing game may be about 7 pounds. The dousing game may be completely assembled and disassembled simply and quickly, may be stored in a compact box, and may weigh very little, making it simple to store, transport, assemble, and use.

In one variation, the dousing game may be scaled for use by children. For example, the dousing game may be made in, for example but not limited to, a 4 foot tall floor version of the game. The dousing game may be completely assembled and disassembled simply and quickly, may be stored in a compact box, and may weigh very little, making it simple to store, transport, assemble, and use.

The dousing game may have additional configurations, including a double, triple, or other variation. For example, two dousing assemblies may be set up side-by-side or back-to-back for team play, as shown in FIG. 10.

The dousing game may also have variations in the size of the target, may have the addition of a water hose or other device for re-filling the container 114 between uses.

While various embodiments of the invention have been described, it will be apparent to those of ordinary skill in the art that many more embodiments and implementations are possible that are within the scope of the invention. For instance, steps of a method as displayed in the figures or reflected in the claims do not require a specific order of execution by way they are presented, unless specified. The disclosed steps are listed as exemplary such that additional or different steps may be executed or the steps may be executed in a different order

We claim:

1. A target game with a fluid indicator, comprising:
a container capable of containing a fluid indicator;
the container having a top and a bottom;
the top of the container oriented above the bottom of the container;
the container assembled below a horizontal bar;
the bottom of the container having a fluid indicator escape opening;
an actuation housing assembled with the horizontal support bar;
the actuation housing having a top vertical opening, a bottom vertical opening, a left horizontal opening, and a right horizontal opening;
the bottom vertical opening located inside the container;
an actuation rod passing through the top vertical opening and emerging from the bottom vertical opening;
the actuation rod having a cap on an end emerging from the top vertical opening;
the actuation rod assembled with a spring;
the actuation rod having a valve on an end emerging from the bottom vertical opening and the valve suspended inside of the container;
the valve removably engaging with the fluid indicator escape opening;
the valve moving between an engaged position and a disengaged position;
wherein in the engaged position, the valve obstructs the fluid indicator
escape opening; and wherein in the disengaged position, the valve
unobstructs the fluid indicator escape opening;
a swing arm assembled above the actuation housing and applying
pressure to the cap; the swing arm connected to a target;
such that when the target is struck by a projectile, the swing arm releases the applied pressure on the cap causing the spring to release potential energy and disengaging the valve from the fluid indicator escape opening.

2. The target game of claim 1, further comprising, the actuation rod passes through the spring.

3. The target game of claim 1, further comprising, the actuation rod is assembled with the spring at a location inside the actuation housing.

4. The target game of claim 1, further comprising, the actuation rod is assembled with the spring at a location above the actuation housing.

5. The target game of claim 1, the container is a bucket.

6. The target game of claim 1, the container is a funnel.

7. The target game of claim 1, further comprising a retaining device.

* * * * *